United States Patent [19]

Steiger

[11] 4,257,595

[45] Mar. 24, 1981

[54] SELF-RESTORING, TORQUE-LIMITING, TORQUE-TRANSMITTING LINKAGE

[76] Inventor: LeRoy A. Steiger, 730 Washington St., Alton, Ill. 62002

[21] Appl. No.: 98,652

[22] Filed: Nov. 29, 1979

Related U.S. Application Data

[63] Continuation of Ser. No. 885,543, Mar. 13, 1978, abandoned.

[51] Int. Cl.[3] ..... A63D 5/02; G05G 1/00

[52] U.S. Cl. ..... 273/49; 74/470

[58] Field of Search ..... 74/529, 470, 599; 273/43 R, 54 A, 49

[56] References Cited

U.S. PATENT DOCUMENTS

| | | | |
|---|---|---|---|
| 983,800 | 2/1911 | Baker | 74/470 |
| 3,297,322 | 1/1967 | Ernst et al. | 273/43 |

*Primary Examiner*—Kenneth Dorner

*Attorney, Agent, or Firm*—Rogers, Eilers & Howell

[57] ABSTRACT

A self-restoring torque-limiting torque-transmitting linkage, for the rudder arm and rudder which drive the pin-moving paddle of an automatic pin setting machine for a lane of a bowling alley, will yield to permit that paddle to be moved if it is engaged by a bowling ball which is exiting from the area at the rear of that lane. That linkage has a first rotatable member and a second rotatable member which normally are held for conjoint rotation by a spring. The first rotatable member is rotated by an eccentric pin on a pulley of the automatic pin setting machine, the second rotatable member is secured to the rudder arm of that automatic pin setting machine to effect rotation of that rudder arm, and the spring normally forces the second rotatable member, and hence the rudder arm and rudder and paddle, to rotate with the first rotatable member. If a bowling ball applies a predetermined force to the paddle, the spring will permit that paddle, the rudder, the rudder arm and the second rotatable member to move independently of the rotation of that first rotatable member. After that force disappears, the spring will again force the second rotatable member, and hence the rudder arm and rudder and paddle, to rotate with the first rotatable member.

6 Claims, 6 Drawing Figures

SELF-RESTORING, TORQUE-LIMITING, TORQUE-TRANSMITTING LINKAGE

This is continuation of application Ser. No. 885,543 filed Mar. 13, 1978 and now abandoned.

SUMMARY OF THE INVENTION

The self-restoring, torque-limiting, torque-transmitting linkage provided by the present invention is interposed between an eccentric pin, on a pulley of an automatic pin setting machine, and the rudder arm, rudder and paddle which are intended to keep pins from exiting through the ball opening at the rear of a bowling lane. That linkage has two rotatable members which are normally held for conjoint rotation by a spring. One of those rotatable members is rotated by an eccentric pin on a pulley of the automatic pin setting machine, a second of those rotatable members is secured to the rudder arm, and the spring normally forces the second rotatable member, and hence the rudder arm and rudder and paddle, to rotate with the first rotatable member. If a bowling ball applies a predetermined force to the paddle, the spring will permit that paddle, the rudder, the rudder arm and the second rotatable member to move independently of the rotation of that first rotatable member. After that force disappears, the spring will again force the second rotatable member, and hence the rudder arm and rudder and paddle to rotate with the first rotatable member. It is, therefore, an object of the present invention to provide a self-restoring, torque-limiting, torque-transmitting linkage, for the rudder arm, rudder and paddle of an automatic pin setting machine, which normally causes that rudder arm, rudder and paddle to rotate in response to rotation of an eccentric pin of that automatic pin setting machine, which will respond to the application of a predetermined force to that paddle to permit that rudder arm, rudder and paddle to move independently of that eccentric pin, and which will respond to the disappearance of that force to again cause that rudder arm, rudder and paddle to rotate in response to rotation of that eccentric pin.

The spring, of the self-restoring, torque-limiting, torque-transmitting linkage provided by the present invention, normally holds a detent within a notch in the second rotatable member of that linkage. That notch, that detent and the pivot for the first and second rotatable members normally define a line; and restorative forces within that spring tend to keep that notch from moving away from that line. However, whenever a bowling ball causes the rudder arm, rudder and paddle to move independently of the first rotatable member of the linkage, the notch will be moved away from that line. That line automatically lenthens as that notch moves away from it, and hence additional restorative forces are developed within the spring. Those additional restorative forces will cause that notch to move back into that line, and will thereby restore the second rotatable member to its normal position relative to the first rotatable member. It is, therefore, an object of the present invention to provide a self-restoring, torque-limiting, torque-transmitting linkage wherein a spring normally holds a detent within a notch in the second rotatable member of that linkage, wherein that detent and notch coact with the pivot for the first and second rotatable members of that linkage to define a line, and wherein that line automatically lengthens when that notch is moved away from that line.

Other and further objects and advantages of the present invention should become apparent from an examination of the drawing and accompanying description.

In the drawing and accompanying description a preferred embodiment of the present invention is shown and described but it is to be understood that the drawing and accompanying description are for the purpose of illustration only and do not limit the invention and that the invention will be defined by the appended claims.

BRIEF DESCRIPTION OF THE DRAWINGS

Referring to the drawing.

DESCRIPTION OF PREFERRED EMBODIMENT

Figures 2, 3:
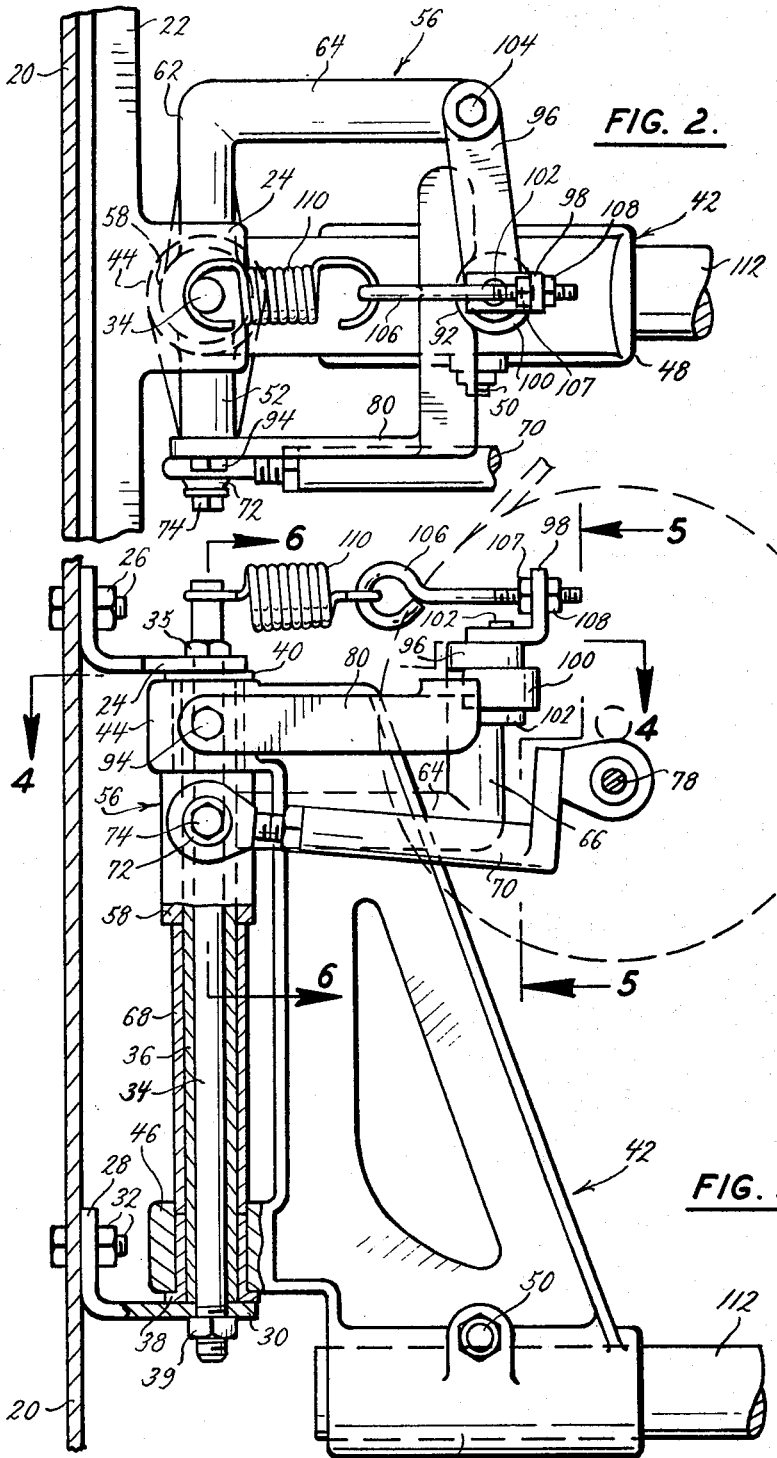
FIG. 2 is a plan view, on a larger scale, of the linkage of FIG. 1.
FIG. 3 is a partially broken-away, partially-sectioned, side elevational view of the linkage of FIG. 1.

Referring to the drawing in detail, the numeral 20 generally denotes a portion of a vertically-directed wall adjacent the rear of a lane in a bowling alley. An elongated horizontal bracket 22 has a vertically-directed portion which abuts the wall 20, and has a horizontally-directed portion which projects outwardly from that wall. A central plate 24 of rectangular configuration is formed at the outer edge of that horizontally-directed portion. Fasteners 26, such as the nut and bolt shown in FIG. 3, secure the bracket 22 to the wall 20. A similar bracket 28 is secured to the wall 20 below, and in register with, the bracket 22 by fasteners 32. The central plate 30 of the bracket 28 is in register with the central plate 24 of the bracket 22. As shown by FIG. 3, the central plate 30 of bracket 28 has an opening therein, and that opening is in vertical registry with an opening, in the central plate 24 of bracket 22, which is indicated by dotted lines in FIG. 3.

The numeral 34 denotes an elongated pivot which has a wrench-receiving annular projection 35 close to the upper end thereof, and which has a threaded lower end. An annular groove 37 is formed in that pivot immediately below the top of that pivot. As indicated by FIG. 3, the threaded lower end of that pivot is passed downwardly through the opening in the central plate 24 of bracket 22 and then through the opening in the central plate 30 of bracket 28. A nut 39 prevents accidental separation of that pivot from the brackets 22 and 28.

The numeral 36 denotes an elongated sleeve which is just slightly shorter than the distance between the confronting faces of the central portions 24 and 30, respectively, of brackets 22 and 28; and that sleeve closely surrounds the major portion of the length of pivot 34. A shouldered bushing 38 surrounds the lower end of sleeve 36, and its shoulder rests upon the upper surface of the central plate 30 of bracket 28. A shouldered bushing 40 surrounds the upper end of sleeve 36, and its shoulder underlies the central plate 24 of bracket 22.

The numeral 42 generally denotes the rudder arm of an automatic pin setting machine manufactured by AMF. That rudder arm has a boss 44 with a vertically-directed opening therein which accommodates the cylindrical portion of bushing 40. That rudder arm also has a boss 46 with a vertically-directed opening therein which accommodates the cylindrical portion of bushing 38. The bosses 44 and 46 are in vertical registry as indicated particularly by FIG. 3. The rudder arm 42 has a split sleeve 48 at the bottom thereof, and a fastener 50 is held by that sleeve. The numeral 52 denotes a boss which extends laterally from the boss 44 of rudder arm 42; and a threaded socket 54 is provided in the outer end of boss 52. The brackets 22 and 28, the elongated sleeve 36, the shouldered bushings 38 and 40, and the rudder arm 42 are manufactured and sold by AMF as components of an automatic pin setting machine; and those components are not, per se, parts of the present invention.

Figure 6:
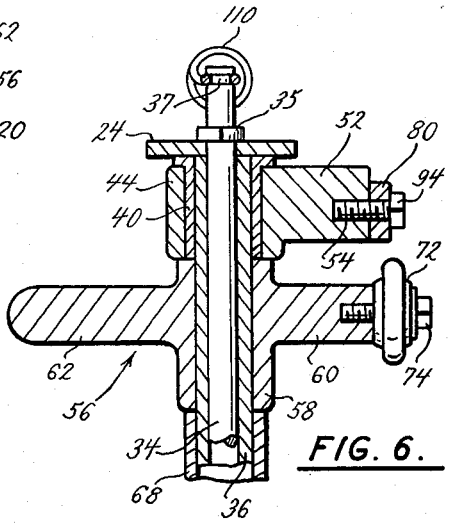
FIG. 6 is another sectional view, on the scale of FIG. 2, through the linkage of FIG. 1, and it is taken along the plane indicated by the line 6—6 in FIG. 3.

The numeral 56 generally denotes a rotatable member which is part of the self-restoring, torque-limiting, torque-transmitting linkage provided by the present invention; and that rotatable member has a sleeve 58, two arms 60 and 62 which extend outwardly from opposite sides of that sleeve, a forward extension 64 of the arm 62, and an upward extension 66 of that arm. The sleeve 58 surrounds a portion of the elongated sleeve 36, as indicated by FIG. 6; and the upper end of sleeve 58 confronts the lower faces of bushing 40 and of boss 44. Sleeve 58 is able to rotate relative to elongated sleeve 36 and to rudder arm 42. The numeral 68 denotes a tubular spacer which encircles a further portion of elongated sleeve 36, as shown by FIGS. 3 and 6; and the lower end of that spacer bears against the upper end of bushing 38, and the upper end of that spacer bears against the lower end of sleeve 58.

The numeral 70 denotes a connecting arm which has an offset at the forward end thereof. A threaded socket in the rear of that connecting arm accommodates the threaded shank of the outer race of a self-aligning bearing 72. The inner race of that bearing accommodates a fastener 74 which is seated within a threaded socket in the arm 60 of rotatable member 56, as shown by FIG. 6. A pulley within the automatic pin setting machine is denoted by the numeral 76; and that pulley has an eccentric pin 78 thereon. A self-aligning bearing on the forward end of the connecting link 70 is connected to that eccentric pin; and rotation of that pulley by a belt 114 will cause the outer end of arm 60 of rotatable member 56 to move forwardly and rearwardly.

The numeral 80 denotes an L-shaped rotatable member which has an arcuate notch 92 in the forward edge thereof. A fastener 94 passes through an opening in the rear portion of rotatable member 80 and seats within the threaded socket 54 in boss 52 of rudder arm 42, as shown by FIG. 6. The rotatable member 80 is dimensioned so the notch 92 thereof is in vertical registry with the sleeve 48 of that rudder arm. The numeral 96 denotes a link which has an L-shaped bracket 98 at the upper face thereof, and which has an anti-friction bearing 100 at the lower face thereof. A machine screw 102 extends upwardly through the inner race of that bearing and through an opening in that link to seat within a threaded opening in the horizontal portion of that bracket. As a result, the bracket 98 and the inner race of bearing 100 move as a unit with link 96. However, the outer race of that bearing will be able to rotate freely relative to that link. The numeral 104 denotes a screw-type pivot which extends downwardly through an opening in the link 96 and seats within a socket in the upward extension 66 of rotatable member 56. The radius of the outer race of bearing 100 is the same as the radius of notch 92 in the forward edge of the L-shaped rotatable member 80.

The numeral 106 denotes an eye bolt which has the threaded shank thereof extending forwardly through an opening in the vertical portion of L-shaped bracket 98. A nut 107 is threaded onto the shank of that eye bolt immediately adjacent the rear face of that vertical portion; and a further nut 108 is threaded onto that shank immediately adjacent the front face of that vertical portion. A washer, not shown, can be disposed between the nut 108 and that vertical portion.

The numeral 110 denotes a strong helical extension spring; and one end of that spring encircles the upper end of elongated pivot 34 and is lodged within the rear portion of the annular groove 37 in that upper end. The other end of that spring passes through the eye of eye bolt 106. The nuts 107 and 108 can be set at different positions along the length of the shank of that eye bolt to provide a desired normal value of restorative forces within spring 110. The numeral 112 denotes the rudder of the automatic pin-setting machine.

Figure 5:
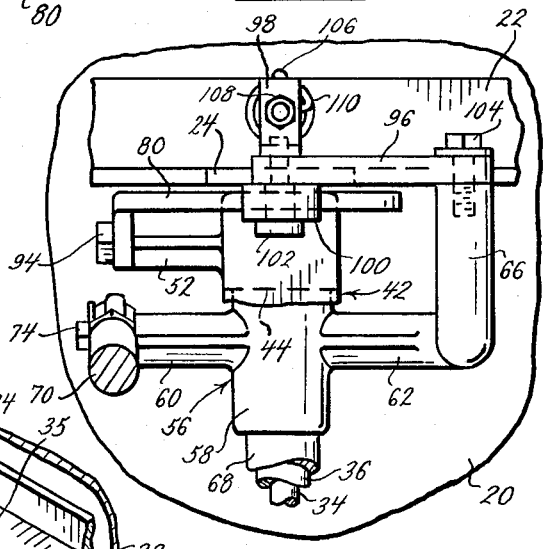
FIG. 5 is a partially broken, partially sectioned, front elevational view, on the scale of FIG. 2, through the upper part of the linkage of FIG. 1.
Figure 1:
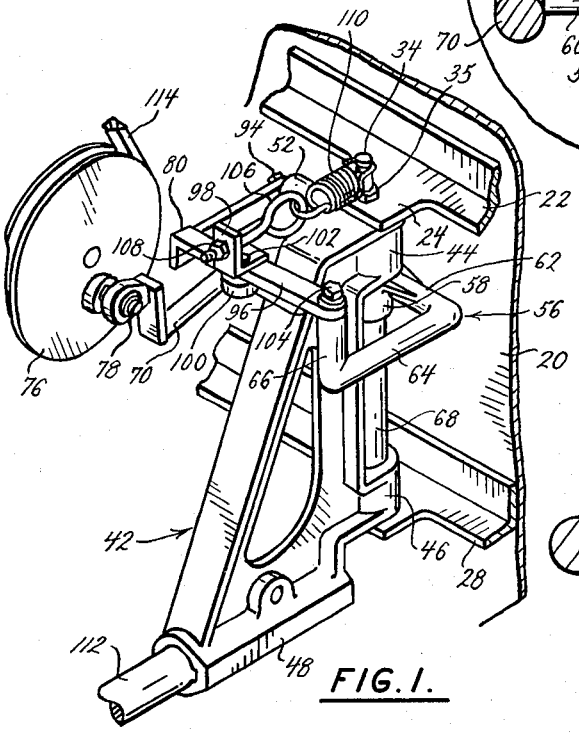
FIG. 1 is a perspective view of one preferred embodiment of self-restoring, torque-limiting, torque-transmitting linkage that is provided by the present invention.

The restorative forces within spring 110 normally hold the outer race of bearing 100 within notch 92 in the forward edge of L-shaped rotatable member 80, as indicated by FIGS. 1, 2 and 5; and that outer race will act as a detent. That outer race, the notch 92, and the elongated pivot 34 normally define a line which is parallel to the axis of rudder 112; and that line is perpendicular to the forward edge of L-shaped rotatable member 80. The restorative forces within spring 110 normally cause the rotatable member 56, the L-shaped rotatable member 80, and the link 96 to rotate as a unitary linkage, and hence enable that unitary linkage to transmit torque from the eccentric pin 78 on pulley 76 to the rudder arm 42. Specifically, as long as spring 110 is able to hold the outer race of bearing 100 within notch 92 of L-shaped rotatable member 80, the connecting arm 70 will cause the rotatable member 56 to oscillate about elongated pivot 34 and sleeve 36; and link 96, bearing 100 and L-shaped rotatable member 80 will force rudder arm 42 to oscillate about that elongated pivot and sleeve in synchrony with rotatable member 56. Consequently, the rudder 112 will be able to oscillate through its intended path of oscillation as long as the paddle, not shown, on the free end of that rudder does not meet any sizeable resistance to its oscillation. As a result, that paddle will be able to keep bowling pins from passing through the ball exit of the bowling lane; and also will be able to push any bowling pins, which tend to lodge within that exit, back through that exit into the area behind that lane.

However, if a bowling ball engages that paddle and moves that paddle away from the ball exit, the force which that ball applies to that paddle will be transmitted to rudder arm 42 by rudder 112. The boss 54 and fastener 94 will respond to that force to cause the L-shaped rotatable member 80 to move with that rudder arm. If the rate and direction of that movement differ from the rate and direction of rotation of rotatable member 56, due to pulley 76, eccentric pin 78 and connecting link 70, the arcuate face of notch 92 will act as a cam and will force the outer race of bearing 100 forwardly out of that notch. Thereupon, the paddle will be able to rotate to whatever extent that is needed to enable the ball to move through the ball exit. In that way, the self-restoring, torque-limiting, torque-transmitting linkage provided by the present invention keeps the paddle, the rudder, and the rudder arm from being subjected to hurtful forces.

Figure 4:
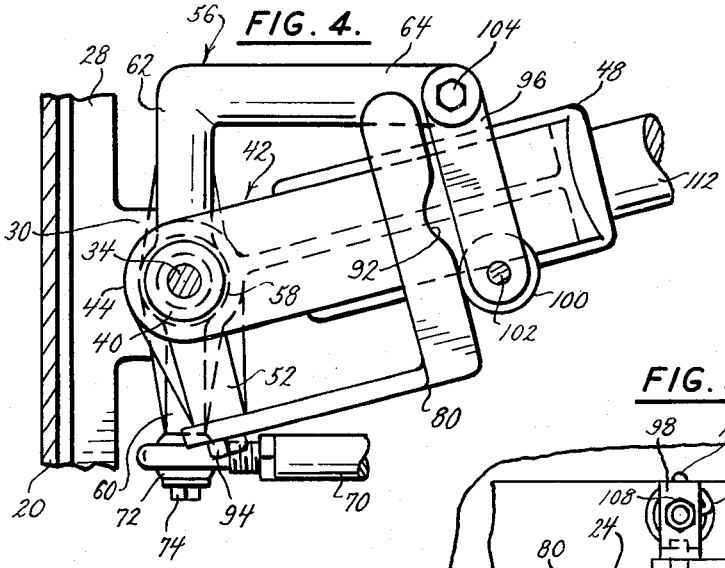
FIG. 4 is a sectional view, on the scale of FIG. 2, through the linkage of FIG. 1, and it is taken along the broken plane indicated by the broken line 4—4 in FIG. 3.

A comparison of FIGS. 2 and 4 shows that the line from pivot 34 to machine screw 102 lengthened when the notch 92 was moved away from that line. That lengthening is due (a) to the camming of the outer race of bearing 100 out of notch 92, (b) to the fact that the line between pivot 34 and machine screw 102 in FIG. 2 represents the altitude of a hypothetical triangle which has the forward edge of L-shaped rotatable member 80 as the base thereof, and (c) to the fact that the line between that pivot and that machine screw in FIG. 4 represents the hypotenuse of that hypothetical triangle. Any rotation of the rotatable member 56 relative to the rudder arm 42, whether in the clockwise direction or in the counterclockwise direction, will cause the line between pivot 34 and machine screw 102 to lengthen to the same extent in which the hypotenuse of a right triangle is greater than the altitude of that triangle.

The overall result is that whether the rotatable member 56 rotates in the clockwise or in the counterclockwise direction relative to the rudder arm 42, additional restorative forces will be developed within the spring 100; and those additional restorative forces will urge the bearing 100 even more strongly to move back intō its position within notch 92. Consequently, as soon as the force which the bowling ball applied to the paddle, to force the L-shaped rotatable member 80 to rotate relative to the rotatable member 56, is released, the overall restorative forces within the spring 100 will pull the bearing 100 back into notch 92. Thereafter until a further heavy force, such as that which a bowling ball could apply to the paddle, is applied to that paddle, the L-shaped rotatable member 80 and the rotatable member 56 will rotate as a unitary linkage. It thus should be apparent that the rotatable member 56, the L-shaped rotatable member 80, and the link 96 constitute a self-restoring, torque-limiting, torque-transmitting linkage which (a) normally causes the rudder arm 42 to rotate in synchrony with the rotatable member 56, (b) will yield, when a substantial force is applied to the paddle by a bowling ball, and thereby will avoid injury to that paddle, to the rudder, to the rudder arm, or it itself, and (c) will automatically restore itself to its normal condition as soon as the substantial force disappears.

The self-restoring, torque-limiting, torque-transmitting linkage provided by the present invention can yield to permit the rudder 112 to rotate in the counterclockwise direction relative to rotatable member 56, as shown by FIG. 4, and also can yield to permit that rudder to rotate in the clockwise direction relative to that rotatable member. As a result, that linkage can be mounted at either side of the bowling lane. Also, that linkage can be mounted between, and then will serve, two bowling lanes. Whether the self-restoring, torque-limiting, torque-transmitting linkage yields to permit rudder 112 to rotate in the counterclockwise or clockwise direction relative to rotatable member 56, that linkage will automatically restore itself.

If desired, the rotatable member 80 could be welded to, or cast as an integral part of, the upper part of the rudder arm 42. Alternatively, that rotatable member could be replaced by a bar which resembled the bar that defines the rear edge of that rotatable member and which was welded to, or cast as an integral part of, the upper part of the rudder arm 42. In either of these two events, the self-restoring, torque-limiting, torque-transmitting linkage provided by the present invention would still have two relatively-rotatable members; but one of those relatively-rotatable members would be an integral part of that rudder arm.

Whereas the drawing and accompanying description have shown and described a preferred embodiment of the present invention, it should be apparent to those skilled in the art that various changes may be made in the form of the invention without affecting the scope thereof.

What I claim is:

1. In a self-restoring, torque-limiting, torque-transmitting linkage which comprises a first rotatable member, a second rotatable member which can rotate with or relative to said first rotatable member, a pivot about which one of said rotatable members can rotate, and means to limit rotation of said one rotatable member to less than a full revolution, the improvement which comprises an elongated surface on said one rotatable member that is fixed and stationary relative to said one rotatable member and is directed so it is generally chordal relative to the path of rotation of said one rotatable member, an element which is secured to the other of said rotatable members and is movable relative to said one rotatable member and hence relative to said surface whenever said second rotatable member rotates relative to said first rotatable member, said surface having a length enabling it to engage said element even if said other rotatable member were held stationary throughout said rotation of said one rotatable member, a biasing member which continuously biases said element into engagement with said surface and which normally tends to hold a portion of said surface and a portion of said element adjacent each other and thereby normally tends to hold said first rotatable member and said second rotatable member in predetermined relative positions for rotation as a unitary linkage, said biasing member responding to the application of a predetermined value of torque to yield and thereby permit relative, independent rotation of said first and second rotatable members out of said predetermined relative positions, said element responding to relative independent rotation of said first rotatable member and said second rotatable member in either direction to move along said surface away from said portion of said surface and thereby increase the distance between said element and said pivot to increase restorative forces within said biasing member, said increased restorative forces urging said element back along said surface toward said portion of said surface regardless of the direction of relative independent rotation between said first rotatable member and said second rotatable member, said element and said surface permitting unimpeded movement of said element from either end of said surface toward said portion of said surface, said biasing member subsequently and automatically responding to said increased restorative forces and to the absence of said predetermined value of torque to cause said first rotatable member and said second rotatable member to re-occupy said predetermined relative positions and thereby again rotate as a unitary linkage, whereby said torque-limiting torque-transmitting linkage will automatically restore itself after each said relative, independent rotation of said first and second rotatable members.

2. A self-restoring, torque-limiting, torque-transmitting linkage as claimed in claim 1 wherein said pivot is a common pivot for said first rotatable member and said second rotatable member, wherein said element is a detent, wherein a notch in said surface and said detent help said biasing member cause said first rotatable member and said second rotatable member to occupy said predetermined relative positions and thereby rotate as a unitary linkage, wherein said notch and said pivot and said detent normally define a line, wherein one of said detent or notch moves away from said line whenever said first rotatable member and said second rotatable member move out of said predetermined relative positions, wherein said line automatically lengthens whenever said one of said detent or notch moves away from said line, and wherein the lengthening of said line automatically increases the restorative forces within said biasing member.

3. A self-restoring, torque-limiting, torque-transmitting linkage as claimed in claim 1 wherein said pivot is a common pivot for said first rotatable member and said second rotatable member, wherein said element is a detent, wherein a notch and said detent help said biasing member cause said first rotatable member and said second rotatable member to occupy said predetermined relative positions and thereby rotate as a unitary linkage, wherein said notch and said pivot and said detent normally define a line, wherein one of said detent or notch moves away from said line whenever said first rotatable member and said second rotatable member move out of said predetermined relative positions, wherein said line automatically lengthens whenever said one of said detent or notch moves away from said line, wherein the lengthening of said line automatically increases the restorative forces within said biasing member, wherein said notch is in said surface on said one member, and wherein said element is on a link pivotally connected to the other of said rotatable members.

4. In a self-restoring, torque-limiting, torque-transmitting linkage which comprises a first rotatable member, a second rotatable member which can rotate with or relative to said first rotatable member, a common pivot about which said first rotatable member and said second rotatable member rotate, and means to limit rotation of said second rotatable member to less than a full revolution, the improvement which comprises a biasing member which normally causes said first rotatable member and said second rotatable member to occupy predetermined relative positions wherein they rotate as a unitary linkage, an elongated surface which is movable with one of said rotatable members, a detent which is movable with the other of said rotatable members and which coacts with said elongated surface to help said biasing member cause said first rotatable member and said second rotatable member to normally occupy said predetermined relative positions and thereby normally rotate as a unitary linkage, said biasing member continuously biasing said detent into engagement with said elongated surface, said detent being movable relative to said elongated surface whenever said second rotatable member rotates relative to said first rotatable member, said elongated surface having a length enabling it to engage said detent even if said first rotatable member were held stationary throughout said rotation of said second rotatable member, said pivot and said detent coacting to define a line of a predetermined length whenever said first rotatable member and said second rotatable member are in said predetermined relative positions, said biasing member responding to the application of a predetermined value of torque to yield and thereby permit relative, independent rotation of said first and said second rotatable members out of said predetermined relative positions, and said elongated surface acting to cause said line to automatically lengthen to increase the restorative forces within said biasing member whenever said first rotatable member and said second rotatable member rotate relative to each other to move out of said predetermined positions, said biasing member subsequently and automatically responding to said increase in the restorative forces within said biasing member and to the absence of said predetermined value of torque to cause said first rotatable member and said second rotatable member to re-occupy said predetermined relative positions and thereby again rotate as a unitary linkage, whereby said torque-limiting torque-transmitting linkage will automatically restore itself after each said relative, independent rotation of said first and second rotatable members.

5. A self-restoring, torque-limiting, torque-transmitting linkage as claimed in claim 2 wherein a notch normally engages said detent, wherein said notch is in said elongated surface, wherein said notch normally helps said pivot and said detent define said line, wherein said line is the altitude of a hypothetical triangle which has said elongated surface as the base thereof, wherein one of said detent or notch moves away from said line to coact with said pivot to define a hypotenuse of said hypothetical triangle whenever said first rotatable member and said second rotatable member move out of said predetermined relative positions, wherein said hypotenuse is longer than said line, and wherein the greater length of said hypotenuse increases the restorative forces within said biasing member.

6. A self-restoring, torque-limiting, torque-transmitting linkage as claimed in claim 2 wherein a rudder arm of an automatic pin-setting machine for a bowling alley is secured to and driven by said first rotatable member, wherein said second rotatable member is moved by the eccentric of said automatic pin setting machine, and wherein a bowling ball can engage the paddle which is carried by the rudder that is connected to said rudder arm to develop said predetermined value of torque.

* * * * *